US006633111B1

(12) United States Patent
Kim et al.

(10) Patent No.: US 6,633,111 B1
(45) Date of Patent: Oct. 14, 2003

(54) ELECTRODELESS LAMP USING $SNI_2$

(75) Inventors: Han Seok Kim, Seoul (KR); Joon Sik Choi, Seoul (KR); Hyung Joo Kang, Kwangmyung (KR); Yong Seog Jeon, Seoul (KR); Hyo Sik Jeon, Kwangmyung (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/500,483

(22) Filed: Feb. 9, 2000

(30) Foreign Application Priority Data

Oct. 15, 1999 (KR) ..... 1999-44798

(51) Int. Cl.[7] ..... H01J 17/20
(52) U.S. Cl. ..... 313/161; 313/637; 313/638
(58) Field of Search ..... 313/161, 637, 313/638, 639, 640, 641, 642; 315/248

(56) References Cited

U.S. PATENT DOCUMENTS

| | | | | | |
|---|---|---|---|---|---|
| 3,764,843 | A | * | 10/1973 | Van Eijl et al. | 313/639 |
| 3,882,343 | A | | 5/1975 | Speros et al. | |
| 3,882,345 | A | | 5/1975 | Kazek et al. | |
| 3,943,402 | A | * | 3/1976 | Haugsjaa et al. | 315/248 |
| 4,360,758 | A | * | 11/1982 | Thornton et al. | 313/27 |
| 4,978,891 | A | * | 12/1990 | Ury | 315/117 |
| 5,831,386 | A | | 11/1998 | Turner et al. | |
| 5,889,368 | A | * | 3/1999 | Doell et al. | 313/493 |
| 6,249,078 | B1 | * | 6/2001 | Mimasu | 313/161 |

FOREIGN PATENT DOCUMENTS

| | | | | |
|---|---|---|---|---|
| DE | 2023770 | | 12/1970 | |
| EP | 0057093 | A1 | 8/1982 | |
| EP | 0382516 | A2 | 8/1990 | |
| EP | 0762476 | A | 3/1997 | |
| GB | 2237927 | A | 5/1991 | |
| JP | 55143773 | A * | 11/1980 | H01J/61/88 |
| JP | 01-311539 | | 12/1989 | |
| JP | 09-503883 | | 4/1997 | |
| JP | 11-054091 | | 2/1999 | |
| KR | 862152 | | 12/1986 | |
| KR | 9712953 | | 3/1997 | |
| WO | 9208240 | | 5/1992 | |

* cited by examiner

*Primary Examiner*—Nimeshkumar D. Patel
*Assistant Examiner*—Karabi Guharay
(74) *Attorney, Agent, or Firm*—Birch, Stewart, Kolasch & Birch, LLP

(57) ABSTRACT

An electrodeless lamp is disclosed. The electrodeless lamp according to the present invention is characterized in that $SnI_2$ is used as a major component filled into a bulb as a filler, and the filler is excited by applying a microwave or high frequency to the bulb for thereby generating a visual ray for thereby obtaining a certain color temperature proper as a light source and implementing a faster light emission start-up at a lower cost without an additive.

17 Claims, 3 Drawing Sheets

ELECTRODELESS LAMP USING $SnI_2$

BACKGROUND OF THE INVENTION

1. Field of the Invention

The present invention relates to an electrodeless lamp, and in particular to an electrodeless lamp using $SnI_2$ as a major component of lamp filler of an electrodeless lamp.

2. Description of the Background Art

An electrodeless lamp is a kind of a high intensity discharge lamp and has advantages in that the life span is long and light effect is better compared to the conventional fluorescent lamp, an incandescent lamp, etc. The electrodeless lamp includes a bulb formed of glass material, a lamp filler sealed in the bulb, and a mean unit for exciting the filler. In particular, the component and amount of the filler filled in the bulb greatly affect the performance of the lamp.

In the conventional electrodeless lamp, as a major component for a filler, there are Hg(mercury)(Korean Patent Publication 86-2152) and a metal halide(Korean Patent Publication 97-12953). In the case of Hg, the application of the same is decreased due to its toxicity, and in the case of a halogen metal halide, it is difficult to obtain a stable and continuous discharge spectrum for decreasing the performance of the lamp.

In another example of the conventional electrodeless lamp, as a bulb filler, there are sulfur, selenium, tellurium, or a compound mixture of the above-described materials. The U.S. Pat. Nos. 5,606,220 and 5,831,386 disclose the lamps using the above-described materials. The above-described lamps excite the filler using a microwave or a high frequency (RF) energy for thereby generating visible light. In this case, the bulb is formed of quartz glass in ball shape or cylindrical shape. A certain amount of Sulfur and inert gas such as Ar, Xe, etc. are filled into the bulb. The above-descried materials are excited by microwave or high frequency energy using a resonator or an induction coupling for enabling the filler to emit light.

The electrodeless lamp has a disadvantage in that it is difficult to emit light at the initial state. In order to overcome the above-described problem, a certain material such as Hg is added or the structure of the resonator is modified. In addition, in the case that the color temperature of emitted light is too high to give a warm and comfortable feel or the intensity of ultraviolet ray is high compared to the intensity of the visible light, in order to properly decrease the color temperature and decrease the intensity of the ultraviolet content, certain materials are added to the filler or the light emitted is reflected back to pass through the bulb. However, in the case that additives are used, the light emitting efficiency of sulfur, selenium, or tellurium is decreased, and in the case that the light emitted is reflected back, the structure of the lamp becomes complicated, so that it is difficult to fabricate the lamp, and thus the fabrication cost of the same is increased.

SUMMARY OF THE INVENTION

Accordingly, it is an object of the present invention to provide an electrodeless lamp which has an adequate color temperature as a light source and implementing a faster light emission start-up at a lower cost without an additive.

To achieve the above objects, as a first example of the present invention, there is provided an electrodeless lamp which is characterized in that $SnI_2$ is used as a major component filled into a bulb as a filler, and the filler is excited by applying a microwave or high frequency energy to the bulb for generating a visible light.

To achieve the above objects, as a second example of the present invention, there is provided an electrodeless lamp which is characterized in that $SnI_2$ is used as a major component filled into a bulb as a filler, and an inert gas such as Ar, Xe, etc. is added as an assistant gas, and the filler is excited by applying a microwave or high frequency energy to the bulb for thereby generating a visible light.

To achieve the above objects, as a third example of the present invention, there is provided an electrodeless lamp which is characterized in that $SnI_2$ is filled as a major component into a bulb as a filler, an inert gas such as Ar, Xe, etc. is added as an assistant gas, and sulfur, selenium, tellurium or metal halide material is added as an assistant material, and the filler is excited by applying a microwave or high frequency to the bulb for thereby generating a visible light.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

In the present invention, $SnI_2$ is used as a major component of a filler filled into a bulb. The present invention provides an electrodeless lamp capable of generating visible light by exciting the filler by applying microwave or high frequency energy. In addition, in the electrodeless lamp, an inert gas such as Ar, Xe, etc. is added as an assistant gas together with a major component.

The amount of the major component of the filler filled in the bulb is preferably below 5 mg/cc with respect to the inner volume of the bulb. The power density of the microwave or high frequency applied into the interior of the bulb is preferably 5~200 W/cc.

In the case of Ar as an assistant gas, the filling pressure is 10~90 torr, and in the case of Xe, the filling pressure is 200~800 torr.

In the present invention, as one feature of the present invention, it is not needed to add an additive such as Hg because the intensity of an electric field needed for an initial discharge is smaller compared to the conventional electrodeless lamp. In addition, a complicated apparatus is not needed for starting up light, namely, it is possible to easily start up light at a lower power density.

Figure 1A:
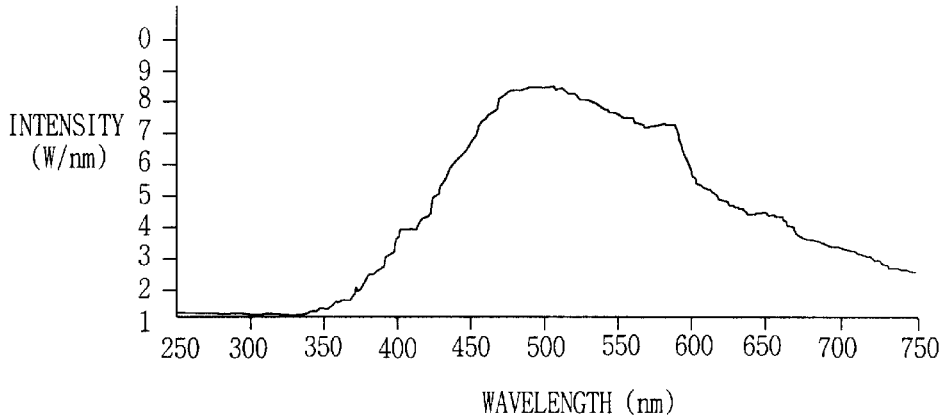
FIG. 1A CONVENTIONAL ART
FIG. 1A is a graph illustrating a spectrum distribution of a conventional electrodeless lamp.
Figure 1B:
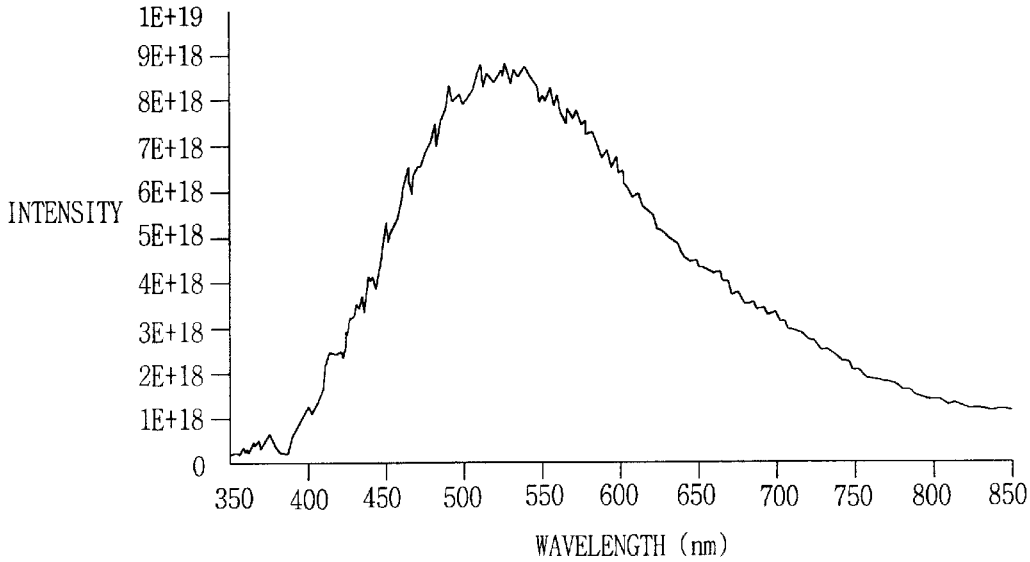
FIG. 1B CONVENTIONAL ART
FIG. 1B is a graph illustrating another spectrum distribution of a conventional electrodeless lamp.

As another feature of the present invention, the color temperature is lower compared to the conventional electrodeless lamp which uses a filler such as sulfur, selenium, or tellurium. Therefore, a complicated mechanism or apparatus is not needed in order to decrease the color temperature for use as a light source. As the color temperature of the light source is increased, the color of the light emitted from the light source is changed from red to white and to blue. In view of a visual sensitivity of a human eye, the preferable color temperature is ranged in 5500~6000 K. The color temperature of an incandescent light is 2700 K, and the same of a fluorescent light is 7000~8000 K. In the case of an electrodeless lamp which uses sulfur as a major component, the color temperature is about 6200~7000 K and a light green or blue color light is emitted. Therefore, in the lamp which uses sulfur as a major component, in order to obtain a comfortable and smooth light, it is needed to properly decrease the color temperature. FIGS. 1A and 1B illustrate a spectrum distribution of an electrodeless lamp which uses Sulfur or Selenium. In these distribution, the wavelength at the highest intensity of the spectrum is related to a color temperature. As shown in FIG. 1A, the wavelength at the highest point of the spectrum is about 500 nm, and as shown in FIG. 1B, the highest point of the spectrum is 500~510 nm. In contrast, in the present invention, the wavelength at the highest point of the spectrum is larger than the conventional electrodeless lamp. Therefore, the color temperature is lower, and it is possible to maintain a proper color temperature as a light source.

Figure 2:
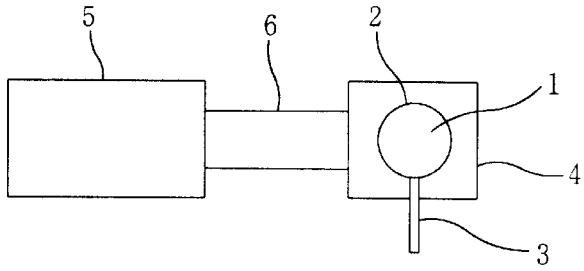
FIG. 2 is a view illustrating the construction of an electrodeless lamp according to the present invention.

The construction of the lamp according to the present invention will be explained with reference to FIG. 2. As shown therein, the lamp includes a bulb 2 having a resonator 4 into which a filler 1 is filled, a bulb fixing unit 3 connected with a motor for rotating the bulb 2, an exciting unit 5 for exciting the filler 1 filled in the bulb, and a transmission unit 6 for guiding the microwave or high frequency energy generated by the exciting unit to the resonator. The lamp excites the filler 1 filled in the bulb 2 using a microwave or high frequency generated by the exciting unit 5 for thereby changing the filler to a plasma state filler. Therefore, a light is emitted from the plasma state filler 1 to the outside of the bulb. When light is emitted, the bulb formed of a glass material such as a quartz, etc. is actually transparent with respect to light emitted. In addition, the bulb fixing unit 3 is connected with the motor and is rotated for thereby cooling heat generated from the bulb.

In the electrodeless lamp according to the present invention, the bulb is preferably formed in a ball shape or cylindrical shape. In the case of the ball shape bulb, the inner diameter is preferably above 5 mm, and in the case of the cylindrical bulb, the ratio between the length of the same and the inner diameter is preferably below 3:1. In the case of the ball shape bulb, if the size of the same is too small, it is difficult to ignite the bulb, the bulb is easily destroyed due to excessive energy density, or the luminous efficacy decreases. In the case of the cylindrical bulb, in order to obtain a uniform plasma distribution, the length of the same should be adequate (should not be too long).

In the present invention, an assistant material such as sulfur, selenium, tellurium or metal halide material is added together with the major component $SnI_2$for thereby adjusting the color temperature or the distribution of the optical spectrum. It is possible to increase a color temperature and a lamp efficiency by adding a certain amount of sulfur. In order to emphasize a certain portion of the spectrum, $T_1I_3$ (green color emphasized), $GaI_3$(yellow color emphasized), etc may be added. The amount of the assistant material is preferably 5~20% of the major component($SnI_2$) and is adjusted in accordance with the kind of the assistant material or the adding purpose.

The examples of the present invention will be explained in detail.

EXAMPLE 1

Figure 3:
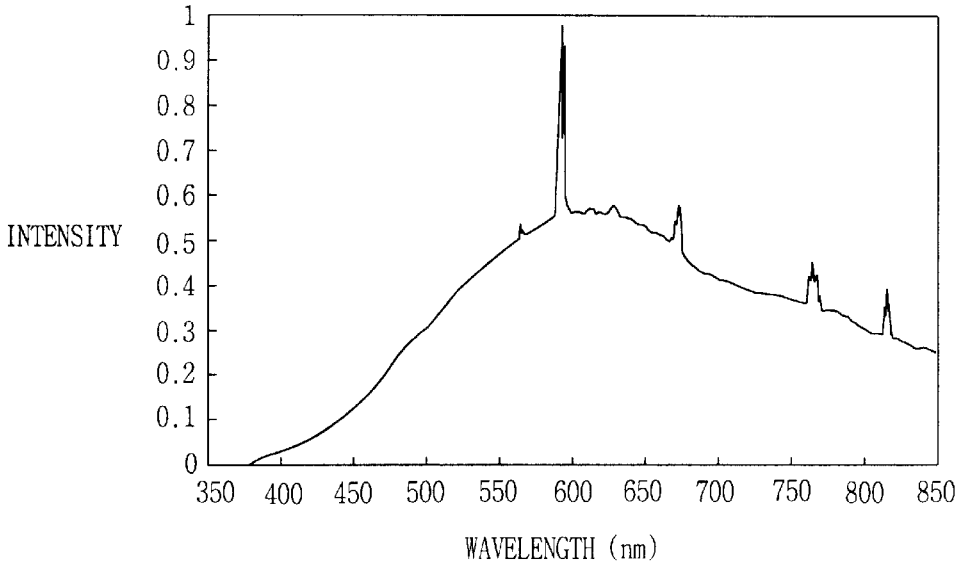
FIG. 3 is a graph illustrating a spectrum distribution of a light emitting bulb according to the first example of the present invention.

25 mg of $SnI_2$, as a major component, is filled into a ball shape bulb having an outer diameter of 30 mm and a thickness of 1.5 mm and formed of a quartz glass material, and as an assistant gas, Ar is filled by a pressure of 10 torr. thereafter, the bulb is excited by microwave power of 900 W to generate visible light. FIG. 3 illustrates a spectrum distribution of the light emitted bulb. In the drawing, the horizontal coordinate is the wavelength, and the vertical coordinate is the intensity of the spectrum. As shown in the spectrum distribution, the wavelength at the highest intensity of the spectrum excluding the line peak is about 610 nm. At this time, the color temperature is about 3600 K, so that it corresponds to a light source which provides a warm and soft light such as an incandescent light or halogen light. In this example, the wavelength is longer and color temperature is low compared to the conventional electrodeless lamp of FIGS. 1A and 1B.

EXAMPLE 2

Figure 4:
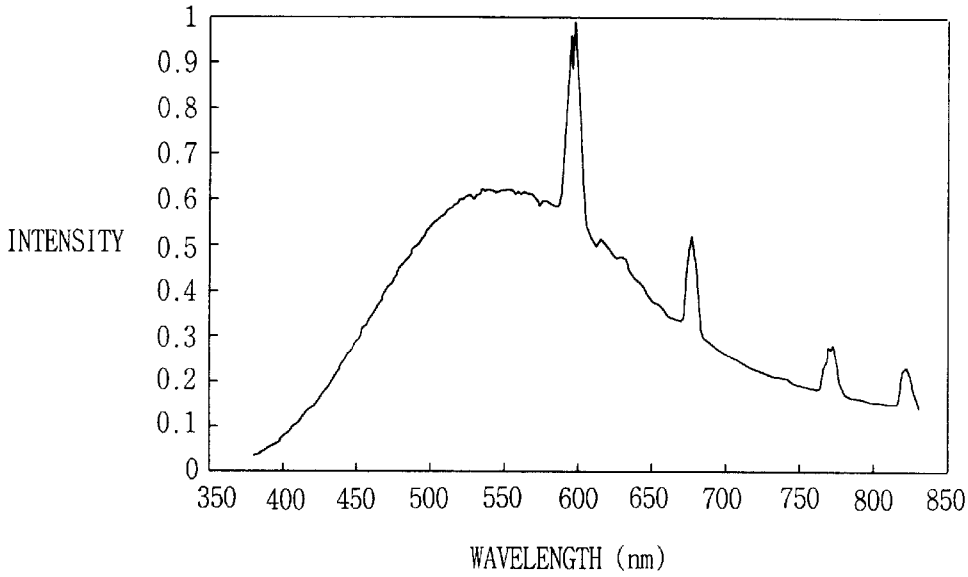
FIG. 4 is a graph illustrating a spectrum distribution of a light emitting bulb according to the second example of the present invention.

15 mg of $SnI_2$, as a major component is filled into a ball shaped bulb having an inner diameter of 27 mm and formed of a quartz glass material as a major component of a filler by 15 mg. As an assistant gas, Ar is filled by a pressure of 10 torr. In addition,as an assistant material, Hg is added by 5 mg, and tellurium is added by 2 mg. the bulb is excited by microwave power of 1 KW to generate visible light. FIG. 4 illustrates a spectrum distribution of the light emitted bulb. As shown in FIG. 4, the wavelength at the highest intensity of the spectrum except for the line peak is about 540 nm, and this time, the color temperature is about 4700 K and corresponds to a white light having a high visual sensitivity.

In the present invention, since the intensity of the electric field needed for an initial discharge is smaller compared to the conventional electrodeless lamp, it is not needed to add an assistant material such as Hg, and a special apparatus for igniting the bulb is not required, and it is possible to easily start up the light at a lower power tensity. In addition, since the color temperature is lower compared to the electrodeless lamp which uses sulfur, selenium or tellurium as a filler, it is not needed to use a complicated mechanism or apparatus in order to obtain a proper color temperature. Therefore, it is possible to provide a high efficiency discharge lamp having a good performance at a lower cost.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. An electrodeless lamp which is characterized in that $SnI_2$ is used as a major component filled into a bulb as a filler, and an assistant material is additionally filled into the bulb, wherein the assistant material is at least one of sulfur, selenium, tellurium or metal halide material, the filler being substantially free of mercury, and the filler is excited by applying a microwave or high frequency energy to the bulb for thereby generating visible light.

2. The lamp of claim 1, wherein an inert gas is added to a filler of the bulb as an assistant gas, and the inert gas is Ar or Xe.

3. The lamp of claim 2, wherein a filling pressure of the Ar is 10~90 torr, and a filling pressure of the Xe is 200~800 torr.

4. The lamp of claim 1, wherein the amount of $SnI_2$ is below 5 mg/cc with respect to the inner volume of this bulb.

5. The lamp of claim 1, wherein a power density of microwave or high frequency applied is 5~200 W/cc.

6. The lamp of claim 1, wherein said bulb has a ball shape.

7. The lamp of claim 6, wherein an inner diameter of the ball shape bulb is above 5 mm.

8. The lamp of claim 1, wherein said bulb is cylindrical.

9. The lamp of claim 8, wherein a ratio of the length and an inner diameter of the cylindrical bulb is below 3:1.

10. An electrodeless lamp which is characterized in that $SnI_2$ is filled as a major component into a bulb as a filler, an inert gas is added as an assistant gas, and sulfur, selenium, tellurium or metal halide material is added as an assistant material, the filler being substantially free of mercury, and the filler is excited by applying microwave or high frequency energy to the bulb for thereby generating a visible light, wherein the inert gas is Ar or Xe.

11. The lamp of claim 10, wherein said inert gas is added to the filler under a filling pressure of a few through hundreds torr.

12. The lamp of claim 10, wherein the amount of $SnI_2$ is below 5 mg/cc with respect to an inner volume of the bulb.

13. The lamp of claim 10, wherein a power density of a microwave or high frequency applied is 5~200 W/cc.

14. The lamp of claim 10, wherein the shape of the bulb is a ball shape.

15. The lamp of claim 14, wherein an inner diameter of the ball shape bulb is above 5 mm.

16. The lamp of claim 10, wherein the shape of the bulb is cylindrical.

17. The lamp of claim 16, wherein a ratio of the length of the cylindrical bulb and an inner diameter of the same is below 3:1.

* * * * *